US009685290B1

(12) United States Patent
Hedeen

(10) Patent No.: US 9,685,290 B1
(45) Date of Patent: Jun. 20, 2017

(54) COMPACT MAGNETIC SWITCH FOR CIRCUIT BOARDS

(71) Applicant: Magnasphere Corporation, Waukesha, WI (US)

(72) Inventor: Joseph C. Hedeen, Menomonee, WI (US)

(73) Assignee: Magnasphere Corporation, Waukesha, WI (US)

( * ) Notice: Subject to any disclaimer, the term of this patent is extended or adjusted under 35 U.S.C. 154(b) by 0 days.

(21) Appl. No.: 15/073,978

(22) Filed: Mar. 18, 2016

(51) Int. Cl.
*H01H 9/00* (2006.01)
*H01H 36/02* (2006.01)

(52) U.S. Cl.
CPC ..... *H01H 36/02* (2013.01)

(58) Field of Classification Search
CPC ..... H01H 36/02; H01H 36/00; H01H 36/004; H01H 36/0046; H01H 5/02; H01H 36/0006
See application file for complete search history.

(56) References Cited

U.S. PATENT DOCUMENTS 5,332,992 A 7/1994 Woods
5,530,428 A 6/1996 Woods
5,673,021 A 9/1997 Woods
5,880,659 A 3/1999 Woods
5,977,873 A 11/1999 Woods
6,087,936 A 7/2000 Woods
6,506,987 B1 1/2003 Woods
6,603,378 B1 8/2003 Collins
6,803,845 B2 10/2004 Woods
7,023,308 B2 4/2006 Woods
RE39,731 E 7/2007 Woods
7,291,794 B2 11/2007 Woods
7,825,801 B2 11/2010 Woods
7,944,334 B2 5/2011 Woods
8,228,191 B2 7/2012 Woods
8,314,698 B2 11/2012 Woods
8,487,726 B2 7/2013 Woods et al.
8,648,720 B2 2/2014 Woods
8,941,397 B2 1/2015 Blank et al.

*Primary Examiner* — Bernard Rojas
(74) *Attorney, Agent, or Firm* — Hovey Williams LLP

(57) ABSTRACT

Small, low-profile magnetic switch assemblies (26, 76, 126, 168) include a base (38, 78, 156) equipped with first and second laterally spaced apart switch electrodes, indentations (62, 102, 158) between the electrodes, and electrically conductive movable components (72, 110, 166), which are magnetically shiftable between a first switch position in simultaneous contact with the base electrodes, and a second switch position out of such simultaneous contact. The switch position of the component (72, 110, 166) is determined by the magnetic field conditions experienced by the component (72, 110, 166). The indentations (62, 102, 158) and associated shiftable components (72, 110, 166) permit the assemblies (26, 76, 126, 168) to be constructed as comparatively tiny units, which may be mounted on circuit boards.

27 Claims, 4 Drawing Sheets

COMPACT MAGNETIC SWITCH FOR CIRCUIT BOARDS

BACKGROUND OF THE INVENTION

Field of the Invention

The present invention is broadly concerned with very small and compact magnetic switch assemblies, which can be mounted on conventional circuit boards. More particularly, the invention is concerned with such switch assemblies having low-profile switch housings with internal electrodes and shiftable components within the housings that are shiftable between separate switch-operating positions depending upon the magnetic field conditions imposed upon the components. The switch assemblies may be used, e.g., as a part of window or door monitoring/alarm systems, or as proximity sensors.

Description of the Prior Art

Prior art alarm systems use magnetic switches attached to doors and/or windows for detecting unauthorized opening thereof. One common type of magnetic switch is a so-called reed switch. This type of switch is subject to unauthorized manipulation through use of an external magnet. That is, an intruder can use a strong magnet held in proximity to the reed switch to hold the switch closed (or open depending upon the control scheme), and thereby open a supposedly protected door or window without triggering the alarm system.

Magnasphere Corporation of Waukesha, Wis. commercializes a specialized type of magnetic switch giving improved performance and protection against external magnet manipulation. Such switches generally comprise a metallic housing with an internal switch ball shiftable between a first position in contact with a pair of switch electrodes and a second position out of such simultaneous contact. Switches of this type are disclosed in U.S. Pat. Nos. 5,977,873 and 7,291,794. Other prior references include U.S. Pat. Nos. 5,332,992, 5,530,428, 5,673,021, 5,880,659, 6,087,936, 6,506,987, 6,603,378, 6,803,845, 7,023,308, RE39,731, 7,825,801, 7,944,334, 8,228,191, 8,314,698, 8,487,726, 8,648,720, and 8,941,397, and EP 2638555.

Although the present-day Magnasphere switches are of inherently small and compact design, they are generally too large for direct mounting on circuit boards. It would be a decided advantage if even more compact switch assemblies could be provided, which retain the unique operating properties of the existing switches, while also being mountable directly on circuit boards.

SUMMARY OF THE INVENTION

The present invention overcomes the problems outlined above and provides very compact and small magnetic switch assemblies, which can be installed in conventional circuit boards. The switch assemblies may also be mounted and soldered directly to circuit boards using automatic welding equipment. The switches may be used as a part of a monitoring/alarm system to detect unauthorized opening of an openable structure such as a door or window. In such contexts, the switches of the invention include a base presenting a lower surface and an opposed upper surface, the base having first and second laterally spaced apart electrodes with an indentation between the electrodes and extending below the upper surface of the base. A cover is secured to the base and extends upwardly therefrom, the base and cover cooperatively presenting a housing. A magnetic operating assembly also forms a part of the switch assembly, and includes an electrically conductive component within the housing and shiftable between a first switch position, wherein the component is in simultaneous electrical contact with the first and second electrodes, and a second shift position, where the component is out of such simultaneous contact. The operating assembly serves to create a magnetic field condition to shift the component to the first switch position when the switch is at one location, and to create a different magnetic field condition to shift the component to the second switch position when the switch is at another location.

The switch operating assembly preferably comprises a biasing element carried by the housing, and a separate actuating component. The switch is shiftable between a position where the housing is adjacent the actuating component, and a position where the housing is remote from the actuating component.

The switches hereof may also be used in other contexts, such as proximity sensors. For example, a magnetic switch assembly suitable for this intended use comprises a base and a cover secured to the base, the base and cover cooperatively defining a housing. The base has a bottom surface and an opposed top surface, and further includes first and second spaced apart electrodes with an indentation between the electrodes and extending below the upper surface of the base. An electrically conductive component is located within the housing and is shiftable between first and second switch positions, depending upon the magnetic field conditions acting on the component, namely a first switch position when the component is in simultaneous contact with the first and second electrodes, the second switch position being when the component is out of such simultaneous contact. The switch remains in one of its switch positions until the switch comes into proximity with a metallic structure which magnetically couples with the shiftable component; at this point, the component shifts to the second switch position, thereby signaling the proximity of the metallic structure.

In preferred forms, the shiftable components of the switches are in the form of spherical balls, but this is not an essential feature of the invention. The shiftable components may be of any convenient shape or size consistent with the geometries of the switch housings. Moreover, the electrodes within the switch housings may be defined by different wall surfaces, such as inclined and/or upright surfaces, so long as appropriate indentations are provided to assure smooth operation of the switch assemblies.

The switch assemblies may be in the form of single-pole, single-throw (SPST) switches, or more complex switch assembly designs, such as single-pole, double-throw (SPDT) switches. In the latter case, the switch housings are provided with third and fourth laterally spaced apart electrodes located above the first and second electrodes, and the electrodes are appropriately configured for SPDT operation.

DETAILED DESCRIPTION OF THE PREFERRED EMBODIMENTS

Figure 19:
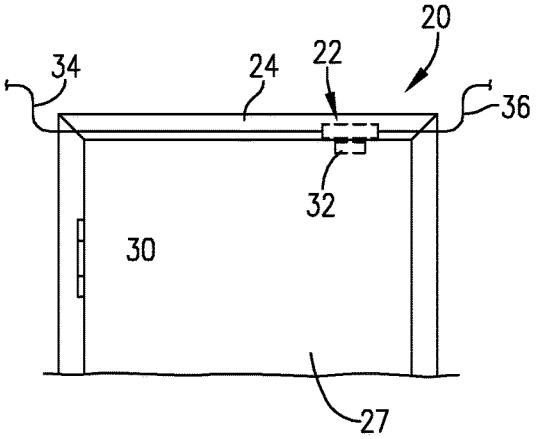
FIG. 19 is an elevational view of a conventional door protected using a magnetic switch in accordance with the invention.

As indicated previously, the switch assemblies of the invention may be used in a variety of contexts. One preferred use thereof is illustrated in FIG. 19, wherein a switch assembly 20 includes a housing 22 adapted to be mounted within a stationary door frame 24 and having a magnetic switch 26 therein. In this illustration, the assembly 20 is designed to monitor the condition of door 27 mounted within frame 24 via hinges 30. The switch 26 operates in conjunction with an actuating body 32 mounted on door 27, so that when the latter is closed, the body 32 is in direct adjacency with the switch 26. The switch 26 is normally located within and as a part of an otherwise conventional circuit board (not shown) having typical monitoring/alarm circuitry. A pair of electrical leads 34, 36 extend from the board and are operably coupled with an alarm or other perceptible door-monitoring device.

Figure 1:
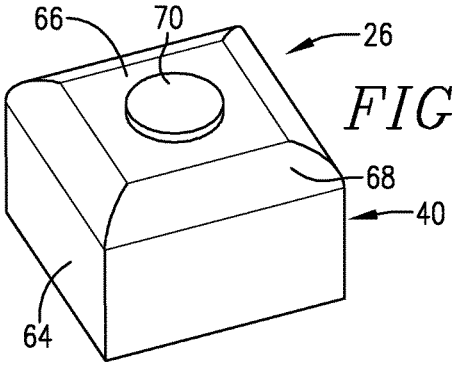
FIG. 1 is a top perspective view of a magnetic switch in accordance with the invention.
Figure 2:
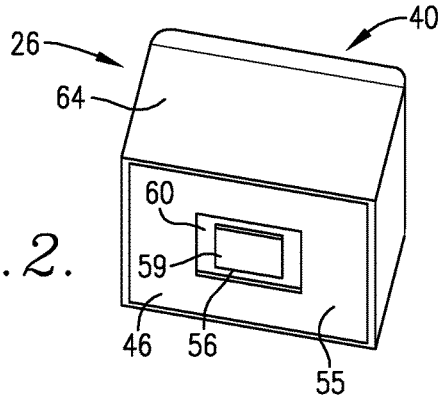
FIG. 2 is a bottom perspective view of the magnetic switch illustrated in FIG. 1.
Figure 4:
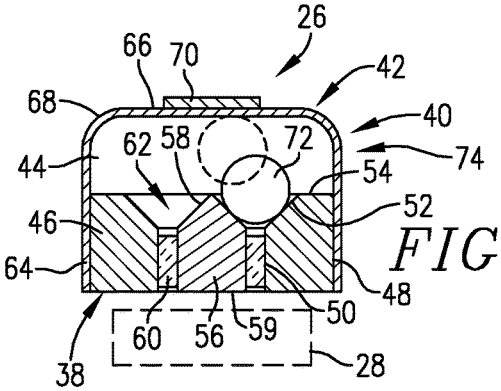
FIG. 4 is a top perspective view similar to that of FIG. 1, but with portions of the switch housing removed to further illustrate the construction of the switch.
Figure 3:
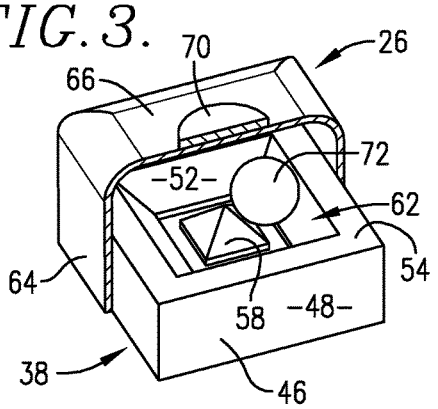
FIG. 3 is a vertical sectional view of the magnetic switch illustrated in FIG. 1, shown in one of its switch-operating conditions.
Figure 5:
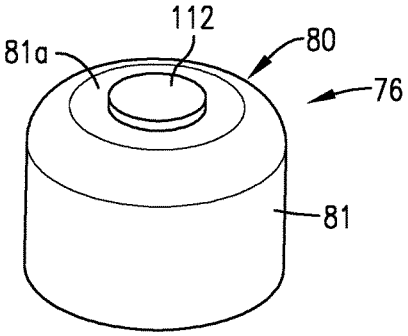
FIG. 5 is a top perspective view of another magnetic switch in accordance with the invention.
Figure 6:
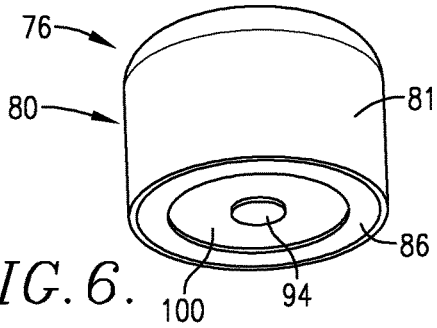
FIG. 6 is a bottom perspective view of the magnetic switch illustrated in FIG. 5.

The magnetic switch 26 is illustrated in FIGS. 1-4 and includes a base 38 and a mating cover 40 cooperatively presenting a housing 42 having an open space 44 above base 38. The base 38 includes a substantially quadrate metallic outer body 46 presenting a vertical, circumscribing outer surface 48 and an inner surface having a vertical face 50, an oblique inboard face 52, a top surface 54, and an opposed bottom surface 55. The base 38 further has a central metallic body 56 presenting a pyramidal upper surface 58 and an opposed bottom surface 59. A substantially quadrate dielectric ring 60 is interposed between central body 56 and outer body 46, as best seen in FIG. 4, in order to electrically isolate the bodies 46, 56. It will be observed that the oblique surface 52 and pyramidal surface 58 cooperatively define a continuous indentation 62, which extends below the top surface 54 and the apex of surface 58. The outer body 46 and central body 56 serve as first and second switch electrodes operably coupled with the leads 34, 36 (see FIG. 2).

The cover 40 may be formed of metallic or synthetic resin material, and includes a quadrate sidewall 64, a top wall 66, and a continuous arcuate shoulder 68 between the walls 64, 66.

The overall magnetic switch 26 also has a biasing disk 70 centrally located on top wall 66, as well as a shiftable component preferably in the form of a spherical switch ball 72 located within space 44. The ball 72 is magnetically shiftable between alternate first and second positions, i.e., a first position shown in bold line in FIG. 4 in simultaneous contact with the oblique and pyramidal surfaces 52, 58, and a second position illustrated in phantom out of such simultaneous contact. Of course, the disk 70 could also be mounted within the interior of the assembly, e.g., on the underside of top wall 66.

The disk 70, ball 72, and actuating body 28 cooperatively provide a magnetic switching assembly broadly referred to by the numeral 74, which serves to operate magnetic switch 26. In preferred forms, the ball 72 is made of a suitable permanent magnetic material (or is coated with such a material), whereas disk 70 and body 28 are made of corresponding metallic materials, which magnetically couple with ball 72, i.e., the materials are capable of attracting the ball 72.

Again referring to FIG. 19 where door 27 is in the closed position with body 32 adjacent housing 22, the magnetic coupling and attraction between body 32 and ball 72 causes the latter to assume the first position, illustrated in FIG. 4, against the bias of disk 70. However, when the door 27 is opened, thereby separating the body 28 and housing 22, the biasing disk 70 comes into play in order to magnetically couple with and shift the ball 72 upwardly to the phantom line position of FIG. 4, wherein the ball 72 is out of the simultaneous electrode contact, and is in contact only with the cover 40. It will be understood though, that the disk 70 and body 28 could be formed of magnetic material, whereas the ball 72 comprises metallic material. In this configuration, the switch 26 would operate in the same manner owing to the magnetic coupling and attraction between the ball 72, disk 70, and body 28. Of course, combinations of these configurations are also possible. What is important is that the magnetic assembly 74 be designed so as to magnetically move the ball 72 between the first and second positions thereof as the result of changing the position of housing 22 relative to body 28.

FIGS. 5-8 illustrate another magnetic switch 76 in accordance with the invention, which also generally includes a base 78 and mating cover 80 cooperatively defining a housing 82, the latter having an open space 84. The base 78 has an outermost annular metallic body 86 presenting an outer surface 88, an opposed inner surface 89, a top surface 90, and an opposed bottom surface 92. Additionally, the base includes a central body 94 having a cylindrical section 95, a conical uppermost surface 96 and a bottom surface 98. A dielectric ring 100 is located between the bodies 86 and 94, with the latter being first and second electrodes. Note also that the ring 100 has a height less than that of the bodies 86, 94, thereby creating a continuous, circular raceway indentation 102 between the inner surface 89 and section 95. Furthermore, the junctures between the surfaces 89 and 90, and between section 95 and surface 96, create a pair of point contact surfaces 104, 106. The cover 80 has a circular sidewall 81 affixed to body 86, and a top 81*a*.

Figure 7:
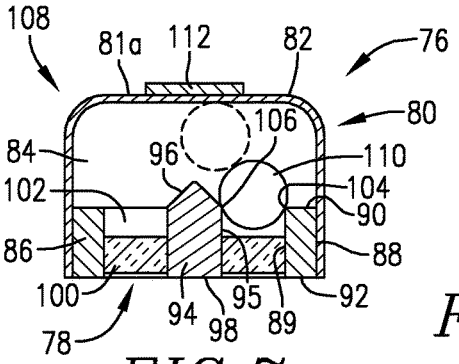
FIG. 7 is a vertical sectional view of the magnetic switch illustrated in FIG. 5.
Figure 8:
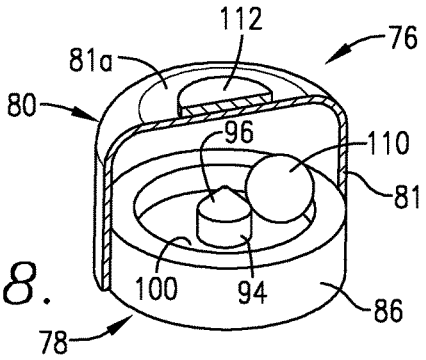
FIG. 8 is a top perspective view similar to that of FIG. 5, but with portions of the switch housing removed to further illustrate the construction of the switch.
Figure 9:
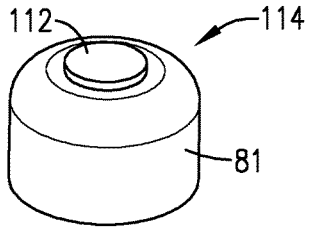
FIG. 9 is a top perspective view of another magnetic switch in accordance with the invention.
Figure 10:
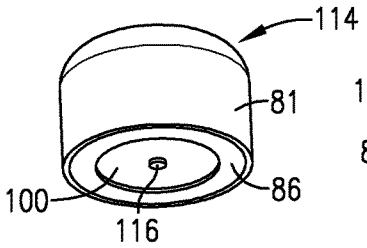
FIG. 10 is a bottom perspective view of the magnetic switch illustrated in FIG. 9.
Figure 11:
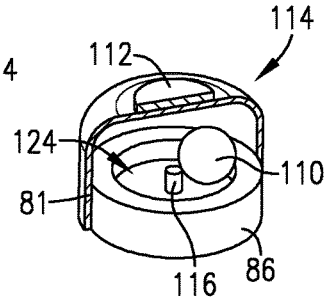
FIG. 11 is a top perspective view similar to that of FIG. 9, but with portions of the switch housing removed to further illustrate the construction of the switch.
Figure 12:
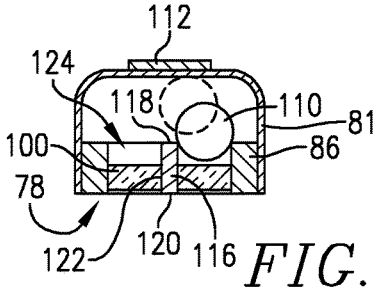
FIG. 12 is a vertical sectional view of the magnetic switch illustrated in FIG. 9.

The switch 76 also includes a magnetic operating assembly 108 including a shiftable switch element in the form of ball 110 and biasing disk 112 mounted on top 81*a*. As illustrated in FIG. 7, the ball 110 is magnetically shiftable between first and second switch positions, as in the case of switch 26. In this connection, note that in the first switch position the ball 110 makes essentially point contact with the surfaces 104, 106, which assists in the prevention of locking or sticking of the ball in the first switch position. The switch 76 operates in exactly the same fashion as switch 26 when used in the context of an alarm switch or the like.

FIGS. 9-12 illustrate a still further embodiment of the invention in the form of a magnetic switch 114. The switch 114 is closely analogous to switch 76, and differs only in the shape of the central body/second electrode thereof. Accordingly, the same reference numerals applicable to switch 76 are used with respect to the switch 114. However, in the switch 114, the central body 116 of the base 78 is in the form of a cylindrical or rod-like element with planar top and bottom surfaces 118, 120 and a circular sidewall 122. Thus, a continuous circular raceway indentation 124 is provided between the bodies 86 and 116.

Figure 13:
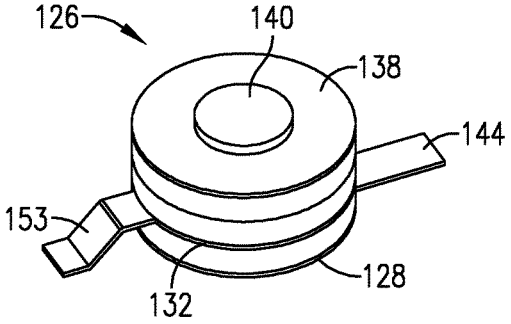
FIG. 13 is a top perspective view of another magnetic switch in accordance with the invention.
Figure 14:
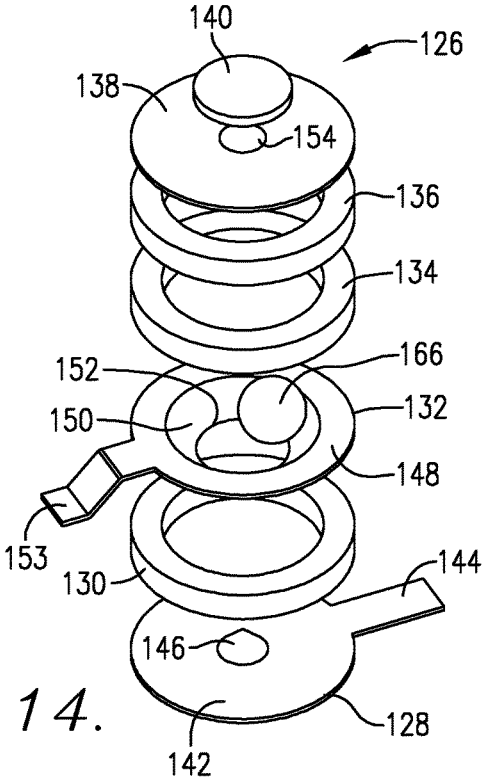
FIG. 14 is an exploded view of the switch depicted in FIG. 13, illustrating the switch parts.
Figure 15:
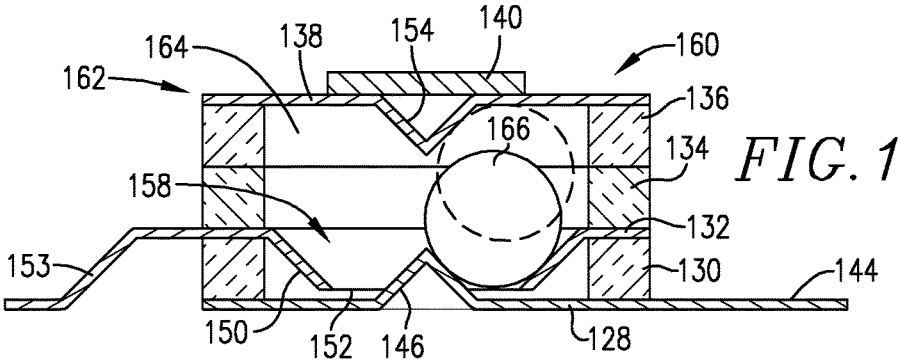
FIG. 15 is a vertical sectional view of the switch illustrated in FIG. 13.

FIGS. 13-15 depict a magnetic switch 126 of somewhat different construction as compared with the earlier embodiments. The switch 126 has, from bottom to top, an electrically conductive bottom plate 128, dielectric ring 130, electrically conductive intermediate annular plate 132, a pair of stacked dielectric rings 134, 136, top plate 138, and biasing disk 140.

In detail, the bottom plate 128 has an essentially circular main body 142 with an outwardly projecting connector tongue 144 and a central, upwardly extending, substantially conical projection 146. The rings 130 and 134, 136 are identical and are simply annular bodies of washer-like construction (if desired, the rings 134, 136, could be replaced by a thicker unitary ring). The annular plate 132 includes an outermost flat peripheral segment 148 with an inwardly and downwardly extending oblique wall 150 terminating in a central opening 152, and an electrical connection tongue 153. The top plate 138 is of circular design and has a central, depending conical projection 154, which is not essential to the operation of switch 126.

As best illustrated in FIG. 15, the plate 128, ring 130, and plate 132 cooperatively define a base 156 for the switch 126, with the wall 150 and projection 146 defining first and second laterally spaced apart electrodes, as well as an indentation 158 therebetween. In like manner, the rings 134 and 136, together with top plate 138 cooperatively define a cover 160, which, in combination with the base 156, creates a housing 162 having an open space 164 therein. Additionally, the switch 126 has a shiftable component, again in the form of an electrically conductive ball 166, which is magnetically moveable between the full and phantom line switch positions of FIG. 15, i.e., between a first switch position in simultaneous contact with projection 146 and wall 150, and a second switch position out of such contact. The operation of switch 126 is again identical with that of the previously described switches, and is dependent upon the magnetic conditions imposed upon the ball 166.

Figure 15A:
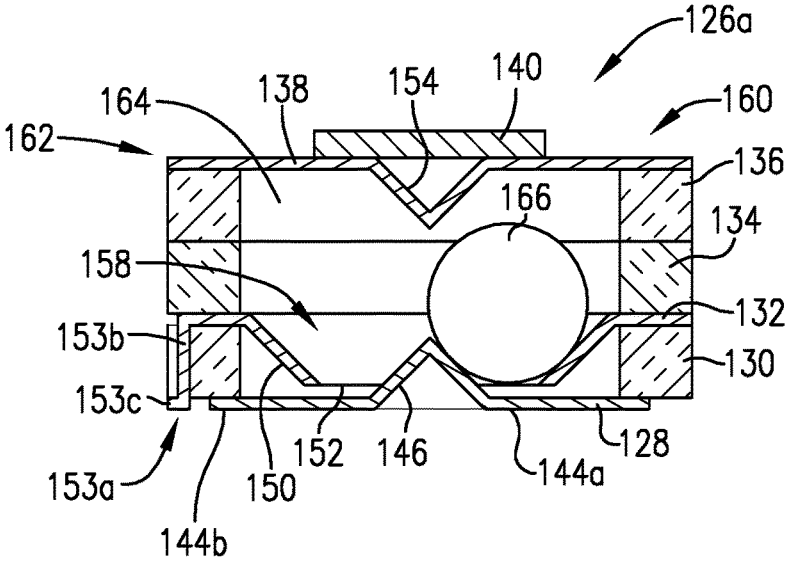
FIG. 15A is a vertical sectional view similar to that of FIG. 15, but illustrating a modified form of the switch of FIG. 13, including internal connectors in lieu of the projecting connection tongues illustrated in FIGS. 13-15.

FIG. 15A illustrates a switch 126*a*, which is identical with switch 126 except for the use of internal connectors 153*a* and 144*a*. As illustrated, the connector 153*a* includes a depending internal leg 153*b* with a short connector pad 153*c*. The connector 144*a* has a connector pad 144*b* adjacent leg 153*b* and pad 153*c*. In all other respects, the switch 126*a* is identical with switch 126.

Figure 18A:
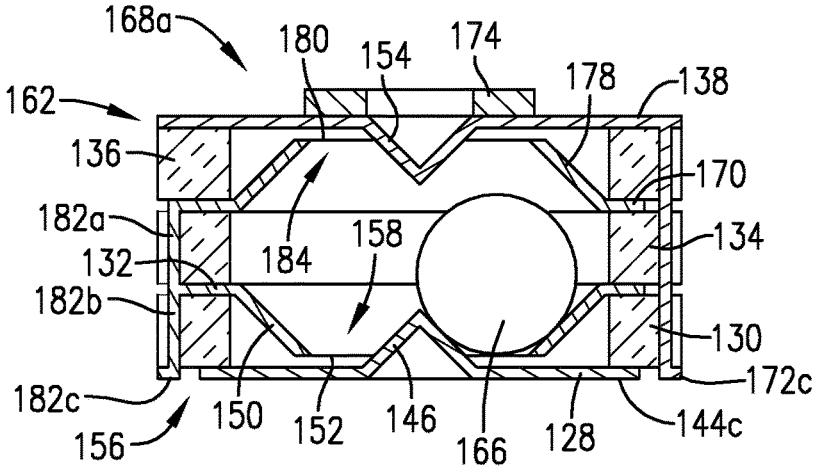
FIG. 18A is a vertical sectional view similar to that of FIG. 18, but illustrating a modified form of the switch of FIG. 16, including internal connectors in lieu of the projecting connection tongues illustrated in FIGS. 16-18.
Figure 16:
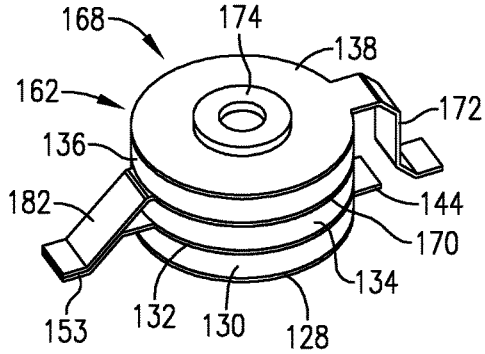
FIG. 16 is a top perspective view of another magnetic switch in accordance with the invention, in the form of a single-pull, double-throw switch.
Figure 17:
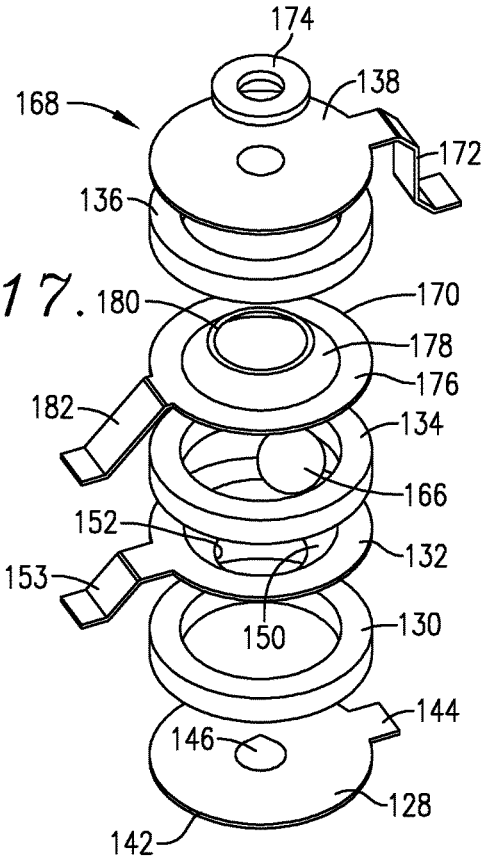
FIG. 17 is an exploded view of the switch depicted in FIG. 16, illustrating the switch parts.
Figure 18:
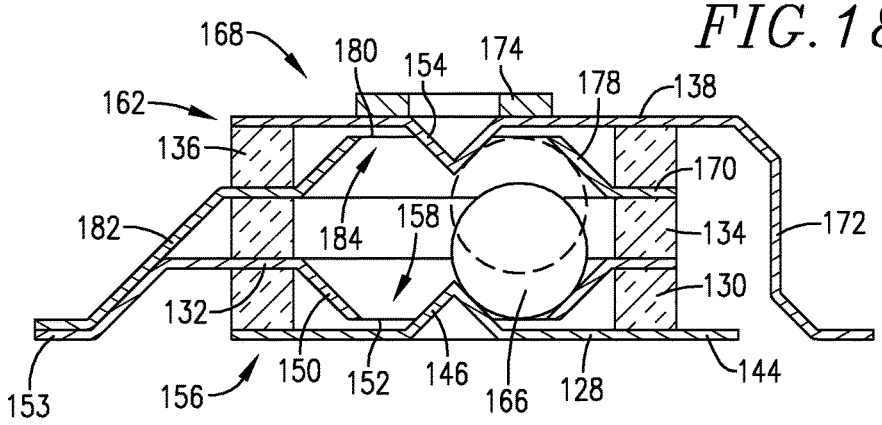
FIG. 18 is a vertical sectional view of the switch illustrated in FIG. 16.

FIGS. 16-18 illustrate a single-pole, double-throw (SPDT) switch 168 in accordance with the invention. The switch 168 has many of the same components as switch 126, and thus like parts have been numbered identically between these two embodiments. There are three principal differences between the switches 126 and 168. In particular, the switch 168 is provided with an intermediate annular plate 170, which is located between the dielectric rings 134 and 136; the top plate 138 is equipped with an electrical connection tongue 172; and the biasing element 174 is in the form of an annular body. The annular plate 170 is in many respects a mirror image of the plate 132, having a circular peripheral segment 176, an upwardly and inwardly extending wall 178 terminating in a central opening 180, and an electrical connection tongue 182. Thus, the wall 178 and the wall defining projection 154 serve as third and fourth electrodes, respectively.

Referring to FIG. 18, it will be seen that the plate 170 is in direct opposition to plate 132, and that the plate 170 and top plate 138 cooperatively define an upper circular raceway indentation 184 as an essentially mirror image to lower indentation 158. The indentation 184 is defined by the conical projection 154 and the wall 178. The ball 166 is magnetically shiftable within the housing 162 between a first switch position shown in bold lines, where the ball 166 simultaneously contacts the first and second electrodes represented by the wall 150 and upwardly extending projection 146, and a second switch position shown in phantom, where the ball simultaneously contacts the third and fourth electrodes represented by the wall 178 and projection wall 154. Finally, the connection tongues 153 and 182 are interconnected by means of soldering or any other suitable means, thus defining the SPDT functionality of the switch 168. The switch 168, when used in the FIG. 19 context, operates exactly as described above, i.e., the ball 166 is magnetically shifted depending upon the magnetic field conditions imposed upon it by body 28 or disk 174, as the case may be.

FIG. 18A illustrates a modified switch 168*a*, which is identical with switch 168 save for the provision of internal connectors 144*c*, 172*a*, and 182*a*. As illustrated, the connector 172*a* has a depending internal leg 172*b* and a connection pad or foot 172*c*. Likewise, the connector 182*a* has a depending internal wall 182*b* and a connection foot or bad 182*c*. The connector 144*c* terminates inboard of the outer surface of the switch 168*a*, as illustrated.

It will be appreciated that while the switches of the invention have been described in the context of a security system for doors, the invention is not so limited. That is, the switches may be used in security systems for windows or any other openable structures, e.g., windows. Moreover, the switches hereof may be used in any environment where a switch condition change is effected by an alteration in the magnetic field condition operating on the ball 72, 110, or 166, or other movable component. For example, the switches can be readily adapted for use as proximity sensors. In this environment, the switches would signal the presence of a body, which magnetically couples with the movable ball within the switch. Thus, the switches can be located at a selected sensing position and, in the event that a magnetic coupling structure comes into proximity with the switches, a magnetic attraction is effected between structure and the switch ball or other movable component, thereby signaling the presence of the coupling structure.

I claim:

1. A magnetic switch assembly comprising:

a base presenting a lower surface and an opposed upper surface, said base having first and second laterally spaced apart electrodes with an indentation between said electrodes and extending below the upper surface of the base;

a cover secured to said base and extending upwardly therefrom, said base and cover cooperatively presenting a housing, said cover having a dielectric tubular section extending upwardly from said base, and an electrically conductive top plate surmounting said tubular section; and a magnetic operating assembly including an electrically conductive component within said housing and shiftable between a first switch position wherein said component is in simultaneous electrical contact with said first and second electrodes, and a second shift position where said component is out of said simultaneous contact, said operating assembly serving to create a magnetic field condition to shift said component to said first switch position when said switch is at one location, and to create a different magnetic field condition to shift said component to said second switch position when said switch is at another location.

2. The assembly of claim 1, said component being a spherical ball.

3. The assembly of claim 1, said operating assembly comprising a biasing element carried by said housing, and a separate actuating component, the switch being shiftable between a position where the housing is adjacent said actuating component, and a position where the housing is remote from said actuating component.

4. The assembly of claim 3, said actuating component formed of a magnetic material, and said biasing element and said actuating component each formed of electrically conductive metallic material.

5. The assembly of claim 3, said biasing element secured to said cover.

6. The assembly of claim 1, there being dielectric material separating said first and second electrodes.

7. The assembly of claim 1, said indentation defined by opposed, inclined faces of said first and second electrodes.

8. The assembly of claim 1, said indentation defined by opposed, upright faces of said first and second electrodes.

9. The assembly of claim 1, said plate having a central, inwardly extending segment.

10. The assembly of claim 1, said first electrode having an upwardly extending central portion, said second electrode positioned above said first electrode and having a downwardly extending wall in opposed relation to and extending around said first electrode central portion.

11. The assembly of claim 10, said first and second electrodes including respective outwardly extending connection tongues.

12. The assembly of claim 10, including third and fourth laterally spaced apart electrodes located above said first and second electrodes, one of said first and second electrodes being electrically connected with one of said third and fourth electrodes, said component being shiftable between a first switch position wherein the component is in simultaneous electrical contact with said first and second electrodes, and a second switch position wherein the component is in simultaneous electrical contact with said third and fourth electrodes.

13. The assembly of claim 12, said third and fourth electrodes presenting an indentation therebetween and positioned above the indentation between said first and second electrodes.

14. The assembly of claim 12, said first electrode electrically coupled with said third electrode.

15. A magnetic switch assembly comprising a base and a cover secured to said base, said cover having a dielectric tubular section extending upwardly from said base, and an electrically conductive top plate surmounting said tubular section, said base and cover cooperatively defining a housing, said base having a bottom surface and an opposed top surface, said base further including first and second spaced apart electrodes with an indentation between said electrodes and extending below the upper surface of the base, a component within said housing and shiftable between first and second switch positions depending upon the magnetic condition acting on said component, said first switch position being when said component is in simultaneous contact with said first and second electrodes, said second switch position being when the component is out of such simultaneous contact.

16. The assembly of claim 15, said component being a substantially spherical ball.

17. The assembly of claim 15, said component comprising magnetic material.

18. The assembly of claim 15, including a biasing element carried by said housing and operable to magnetically couple with said component.

19. The assembly of claim 15, there being dielectric material separating said first and second electrodes.

20. The assembly of claim 15, said indentation defined by opposed, inclined faces of said first and second electrodes.

21. The assembly of claim 15, said indentation defined by opposed, upright faces of said first and second electrodes.

22. The assembly of claim 15, said plate having a central, inwardly extending segment.

23. The assembly of claim 15, said first electrode having an upwardly extending central portion, said second electrode positioned above said first electrode and having a downwardly extending wall in opposed relation to and extending around said first electrode central portion.

24. The assembly of claim 23, said first and second electrodes including respective outwardly extending connection tongues.

25. The assembly of claim 23, including third and fourth laterally spaced apart electrodes located above said first and second electrodes, one of said first and second electrodes being electrically connected with one of said third and fourth electrodes, said component being shiftable between a first switch position wherein the component is in simultaneous electrical contact with said first and second electrodes, and a second switch position wherein the component is in simultaneous electrical contact with said third and fourth electrodes.

26. The assembly of claim 25, said third and fourth electrodes presenting an indentation therebetween and positioned above the indentation between said first and second electrodes.

27. The assembly of claim 25, said first electrode electrically coupled with said third electrode.

* * * * *